US005417136A

United States Patent [19]

Kralik et al.

[11] Patent Number: 5,417,136

[45] Date of Patent: May 23, 1995

[54] CONGA RIM

[75] Inventors: Donald M. Kralik, West Milford; Wayne E. Cohen, Cliffside Park, both of N.J.

[73] Assignee: Latin Percussion Inc., Garfield, N.J.

[21] Appl. No.: 184,288

[22] Filed: Jan. 21, 1994

[51] Int. Cl.[6] ..... G10D 13/02

[52] U.S. Cl. ..... 84/411 R; 84/411 A

[58] Field of Search ..... 84/411 R, 412, 413, 84/419, 420, 411 A

[56] References Cited

U.S. PATENT DOCUMENTS

| | | | |
|---|---|---|---|
| 283,352 | 8/1883 | McCord | 84/411 R |
| D. 308,217 | 5/1990 | Cohen | 84/411 R |
| 3,362,275 | 1/1968 | Koishikawa | 84/411 R |
| 3,482,479 | 12/1969 | Della-Porta | 84/411 R |
| 3,492,904 | 2/1970 | Koishikawa | 84/411 R |
| 3,626,801 | 12/1971 | Moore | 84/411 R |
| 4,184,407 | 1/1980 | Townshend | 84/411 R |
| 4,214,504 | 7/1980 | Rex | 84/411 R |
| 4,218,952 | 8/1980 | Arbiter | 84/411 A |
| 4,520,709 | 6/1985 | Kester, Jr. | 84/413 |
| 4,619,179 | 10/1986 | Wright | 84/411 R |
| 4,709,613 | 12/1987 | Powers et al. | 84/411 R |
| 4,742,752 | 5/1988 | Lubbers | 84/413 |
| 4,754,683 | 7/1988 | Townsend et al. | 84/413 |

OTHER PUBLICATIONS

Comfort Curves ® Rim, p. 8 of Latin Percussion Catalog 1989.

*Primary Examiner*—Howard B. Blankenship
*Assistant Examiner*—Cassandra Spyrou
*Attorney, Agent, or Firm*—Brumbaugh, Graves, Donohue & Raymond

[57] ABSTRACT

A drum rim includes inner and outer rim portions. The outer rim portion is smoothly tapered to provide comfort to the hands of the player. An inner rim portion is arranged to engage the drum skin at a position that has a diameter which is less than the central diameter of the drum wire.

3 Claims, 1 Drawing Sheet

CONGA RIM

BACKGROUND OF THE INVENTION

This invention relates to drums, particularly hand-played drums such as bongo drums and conga drums, and relates to improved arrangements for mounting a natural or synthetic drum skin to the drum body. The skin mounting arrangement for such hand-played drums must hold the edges of the skin firmly, but should also provide a smooth contoured surface that will be comfortable to the player's hands as he strikes the outer edge of the drum skin while playing the instrument.

Latin Percussion, the assignee of the present invention, has marketed bongo and conga drums for more than one year with its "Comfort Curve ®" rim, which is a rim having an inverted J-shaped cross-section, wherein the shorter edge of the rim bears against the skin and clamps the skin against the drum wire at a diameter that is less than the centerline diameter of the drum wire. The rim itself is shown in U.S. Des. Pat. No. 308,217 granted May 29, 1990.

The curvature of the top edge of the Comfort Curve rim provides a surface that is not sharp when struck by the hand. Nevertheless, long playing can still be uncomfortable since the curved portion of the rim projects outward into a region that can be struck by the heel of a player's hand.

Another prior arrangement is a drum rim having a lower cylindrical portion and an upper conical portion, wherein the conical portion engages the skin against the drum wire. This arrangement provides a smooth and tapered exterior surface, which is comfortable to play, but does not provide a secure engagement of the skin, since the conical portion engages the skin against the wire at a position that is radially outside the wire centerline. Accordingly, downward force on the rim tends to pull the skin around the wire in a direction that lessens tension on the skin. In addition, this arrangement does not provide for positive location and angular orientation of the rim. Accordingly, it is possible for the rim to be skewed such that the upper portion of the rim engages and clamps the skin against the drum body, thereby interfering with the desired skin vibrational properties and degrading the tone of the drum.

It is therefore an object of the present invention to provide a new and improved drum having a drum rim which is comfortable to the player's hands, which provides a positive location of the drum rim and which securely tensions the drum skin.

SUMMARY OF THE INVENTION

In accordance with the invention there is provided a drum comprising a generally cylindrical drum body having an open top end and a cylindrical axis, a skin stretched over said open top end and wrapped around a skin wire at its peripheral edge, and a rim for holding and tensioning the skin. According to the invention, the rim is comprised of an outer circular rim portion having a cross-sectional shape comprising a lower cylindrical section extending parallel to the central axis, a radial upper section extending perpendicular to the central axis and a conical intermediate section having an exterior surface which smoothly joins the cylindrical outer surface of the lower section to the radial surface of the upper section. The rim includes an inner circular rim portion joined to the interior of the outer rim portion and having a lower surface for engaging the skin at a diameter less than the central diameter of the skin wire and including a sharp corner forming the lower interior edge thereof.

In a preferred embodiment of the invention the inner circular rim portion has a cylindrical shape and a flat lower surface having an outer edge with a diameter less than the central diameter of the skin wire.

For a better understanding of the present invention, together with other and further objects thereof, reference is made to the following description, taken in conjunction with the accompanying drawings, and its scope will be pointed out in the appended claims.

DESCRIPTION OF THE PREFERRED EMBODIMENT

Figure 1:
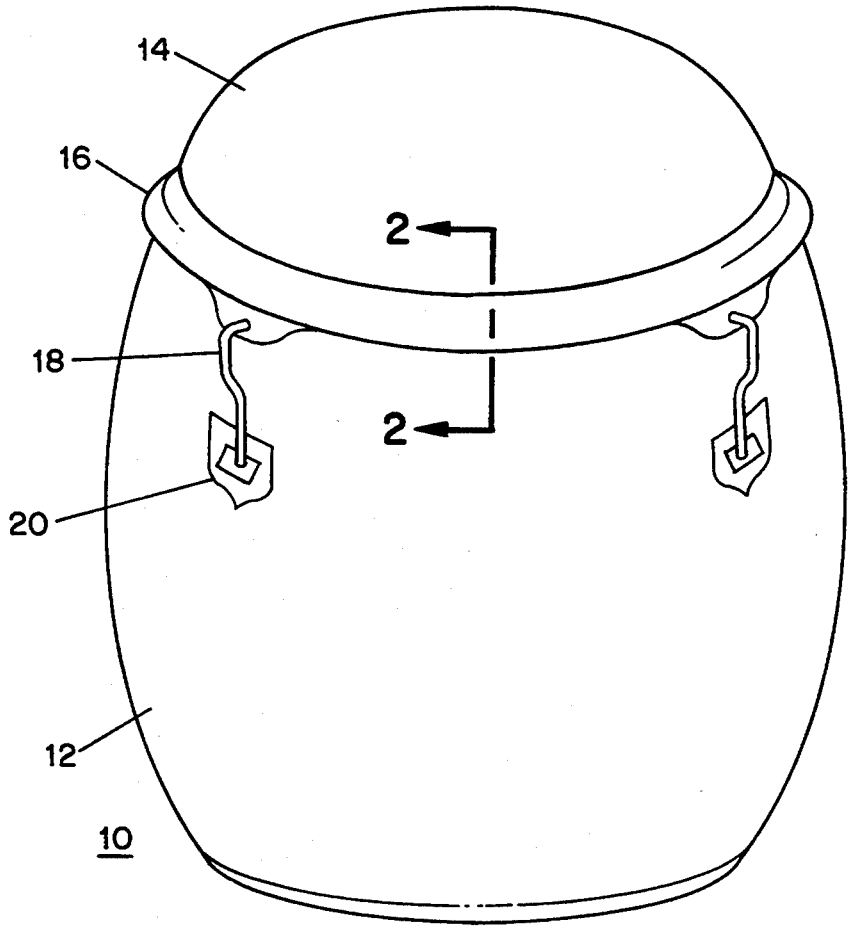
FIG. 1 is a perspective view of a drum according to the present invention.
Figure 2:
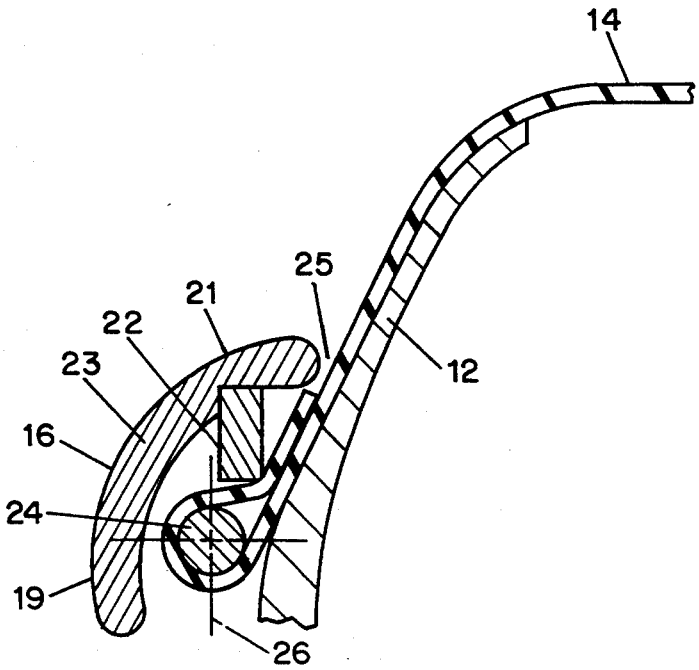
FIG. 2 is a cross-sectional view of the FIG. 1 drum.

As shown in FIG. 1 a conga drum 10, according to the present invention, has a body 12 and a drum skin 14 which is mounted on body 12 by use of mounting rim 16, which is tensioned using conventional hooks 18 which engage flanges 20 on the body 12. FIG. 2 is a detailed cross-sectional view showing the arrangement for mounting skin 12 by use of rim 16 according to the present invention. As shown in FIG. 2, body 12 is tapered in the region of its open top end. Skin 14 covers the open top end of body 12 and is wrapped around a skin wire 24.

Drum rim 16 includes an outer rim portion having a lower generally cylindrical section 19, an upper radial section 21 and a conical intermediate section 23 which smoothly joins lower section 19 and upper section 21. Upper section 21 is preferably dimensioned to provide a gap 25 of about a eight inch between the rim 16 and the body 12 of the drum 10. The outer surface of drum rim 16 is smoothly tapered and maintained close to drum body 12 to provide a smooth and recessed surface which is out of the path of the player's hands when performing on the drum. Drum rim 16 includes an inner rim portion 22 which in the illustrated embodiment is cylindrical and joined to the interior of the outer rim portion, by welding or the like. Inner rim portion 22 preferably has a flat lower surface and a sharp lower inner edge, which engages the skin to firmly hold it around the drum wire 24. It should be noted that because inner rim portion 22 engages skin 14 at a position which is at a smaller diameter than the central diameter 26 of skin wire 24, there is provided a positive location and orientation of the rim. Further, tensioning the drum skin by tightening hooks 18 of rim 16 tends to lock skin 14 around wire 24. The inventors have discovered that earlier tapered drum rims, wherein the rim engages skin 14 at a diameter which is larger than the center line diameter of wire 24, do not provide positive location for the drum rim and have a tendency to allow the skin to loosen. The present invention avoids this problem while also providing user comfort.

While there has been described what is believed to be the preferred embodiment of the prevent invention those skilled in the art will recognize that other and further modifications may be made thereto, and it is intended to claim all such changes and modifications as fall within the true scope of the invention.

We claim:

1. In a drum comprising a generally cylindrical drum body having an open top end and a central axis, a skin wire having a central diameter, a skin stretched over said open top end and wrapped around said skin wire at a peripheral edge of said skin and a rim engaging and tensioning said skin, the improvement wherein said rim is comprised of:

an outer circular rim portion having a cross-sectional shape comprising:

a lower cylindrical section extending parallel to said central axis, said lower section having a cylindrical outer surface, a radial upper section extending perpendicular to said central axis, said upper section having an upper radial surface, and a conical intermediate section having an exterior surface which smoothly joins the cylindrical outer surface of said lower section to the upper radial surface of said upper section; and an inner circular rim portion joined to said outer rim portion, extending downwardly from said radial upper section toward said drum body and having a lower edge means for engaging said skin.

2. An improved drum as specified in claim 1 wherein said inner circular rim portion has a cylindrical shape.

3. An improved drum as specified in claim 2 wherein said lower edge means comprises a flat lower surface having an outer edge being at a distance from said drum body smaller than said central diameter of said skin wire.

* * * * *